US005302115A

United States Patent [19]

Hagar et al.

[11] Patent Number: 5,302,115

[45] Date of Patent: Apr. 12, 1994

[54] BURNER REGISTER ASSEMBLY

[75] Inventors: Donald K. Hagar, Emmans; Lyle D. Geiger, Fogelsville, both of Pa.

[73] Assignee: Damper Design, Inc., Allentown, Pa.

[21] Appl. No.: 990,948

[22] Filed: Dec. 14, 1992

Related U.S. Application Data

[63] Continuation of Ser. No. 555,817, Jul. 20, 1990, abandoned, which is a continuation of Ser. No. 277,636, Nov. 19, 1988, abandoned, which is a continuation of Ser. No. 56,429, Jun. 1, 1987, abandoned, which is a continuation of Ser. No. 673,851, Nov. 21, 1984, abandoned, which is a continuation of Ser. No. 418,434, Sep. 15, 1982, Pat. No. 4,504,216.

[51] Int. Cl.[5] ..... F23M 9/00

[52] U.S. Cl. ..... 431/183; 239/402; 431/182; 431/184; 431/188

[58] Field of Search ..... 126/110 R; 239/402, 239/403, 404, 405, 406; 431/9, 173, 176, 178, 182, 183, 184

[56] References Cited

U.S. PATENT DOCUMENTS

| | | | |
|---|---|---|---|
| 1,235,855 | 8/1917 | Stillman | 239/402 |
| 1,519,846 | 12/1924 | Kleffel | 431/183 |
| 1,602,180 | 10/1926 | Stillman | 431/183 |
| 1,843,662 | 2/1932 | Craig et al. | 431/183 |
| 1,994,461 | 3/1935 | Boland | 431/183 |
| 2,087,869 | 7/1937 | Blodgett | 431/183 |
| 2,320,575 | 6/1943 | Dunn | 239/402 |
| 2,325,318 | 7/1943 | Hendrix | 431/185 |
| 2,325,442 | 7/1943 | Vroom | 431/183 |
| 2,341,682 | 2/1944 | Andrews | 110/104 R |
| 2,515,813 | 7/1950 | Wiant | 431/183 |
| 2,815,069 | 12/1957 | Garraway | 431/188 |
| 2,973,032 | 2/1961 | Reilly et al. | 431/266 |
| 3,007,084 | 10/1961 | Thomasian et al. | 431/184 |
| 3,648,457 | 3/1972 | Bobo | 431/183 |
| 3,746,499 | 7/1973 | Guerre et al. | 431/182 |
| 3,922,137 | 11/1975 | Peczeli et al. | 431/183 |
| 4,120,640 | 10/1978 | Martin | 431/353 |
| 4,245,980 | 1/1981 | Reed et al. | 431/182 |
| 4,326,702 | 4/1982 | Oueneau et al. | 110/264 |
| 4,333,405 | 6/1982 | Michelfelder et al. | 110/264 |
| 4,381,718 | 5/1983 | Carver et al. | 110/347 |
| 4,504,216 | 3/1985 | Hagar et al. | 431/183 |

FOREIGN PATENT DOCUMENTS

| | | |
|---|---|---|
| 3048201 | 7/1982 | Fed. Rep. of Germany . |
| 582493 | 12/1924 | France . |
| 509251 | 8/1939 | United Kingdom . |
| 879224 | 10/1957 | United Kingdom . |
| 2043871 | 9/1980 | United Kingdom . |

*Primary Examiner*—Noah P. Kamen
*Attorney, Agent, or Firm*—Foley & Lardner

[57] ABSTRACT

Disclosed is a burner register assembly having an air register assembly for imparting a controlled vortex swirl to secondary combustion air of a furnace in order to entrain the fuel and primary air of the furnace and carry them into the furnace interior. The assembly may comprise a series of arcuate vanes circumferentially spaced about the fuel and primary air nozzle, the vanes being designed to induce both turbulence and a well defined vortex to the secondary air flow. A separate air valve, such as a butterfly valve, is provided upstream of the air register assembly to regulate the volume of secondary air flow. Shadow vanes may also be provided in the vicinity of the air register assembly outlet, and positioned adjacent the furnace walls in order to protect the air register assembly from furnace heat, particularly when the burner associated with the air register assembly is idle and the secondary air flow is lowered.

15 Claims, 2 Drawing Sheets

BURNER REGISTER ASSEMBLY

This application is a continuation of application Ser. No. 07/555,817, filed Jul. 20, 1990 (now abandoned), which was a continuation of application Ser. No. 277,636 filed Nov. 28, 1988 (now abandoned) which, in turn, was a continuation of application Ser. No. 056,429 filed Jun. 1, 1987 (now abandoned), the latter being a continuation of Ser. No. 673,851 filed Nov. 21, 1984 (now abandoned) which, in turn, was a continuation of Ser. No. 418,434 filed Sep. 15, 1982 (now U.S. Pat. No. 4,504,216).

FIELD OF THE INVENTION

The present invention relates to gas registers and more particularly to registers for controlling the amount and flow pattern of secondary air supplied to a burner. More particularly still, the present invention relates to gas registers for creating a defined well vortex flow of secondary air to entrain the combustible matter being fed into a furnace.

BACKGROUND OF THE INVENTION

The present invention is primarily directed to coal fired furnaces although it will be understood by the artisan that a similar system can also be used on oil fired furnaces, hybrid coal/oil furnaces, gas fired furnaces and furnaces which burn other materials. It should therefore be understood that while the description which follows is directed to pulverized coal burning furnaces, that is by way of example only and not a limitation. The present invention is generally applicable in any furnace requiring excess air to assure complete combustion or furnaces requiring excess air as load is reduced.

Typical prior art burner arrangements for a furnace comprises a burner or coal nozzle through which pulverized coal and primary air are introduced into the furnace. The primary air typically supplies only about 20 percent of the air needed to fully oxidize the fuel. Therefore, each burner nozzle is provided with a secondary air supply. The secondary air supply typically consists of a "windbox" or air plenum that is in communication with a burner register. The prior art burner registers are of two general types. The first type utilizes pivoting slat vanes journaled between two ring members to form a band The coal nozzle is centrally located along the axis of the band. The vanes pivot from a fully closed position, where the end of one slat coincides with the beginning of the next thus forming a closed ring about the fuel nozzle, to an open position where the vanes are positioned generally radially with respect to the fuel nozzle, thus permitting the free flow of secondary air. Such a register utilizes a single assembly to perform the dual functions of controlling both the volume and direction of the secondary air supply. An example of such a register is taught in Chapter 9 of "Steam/Its Generation and Use" by the Babcock and Wilcox Company, 1978 Edition.

The second type of prior art secondary air register is formed from a plurality of movable, radial "pie" shaped wedges which in the closed position form a closed circular valve surface and which, as opened, operates to control the volume and direction of secondary air introduced from an associated windbox into the furnace along with the fuel and primary air. These prior art arrangements suffer from various deficiencies (discussed below) which the present invention has overcome.

Owing to their considerable number of required interrelated moving parts, which were subjected to the severe environmental conditions existing in the space adjacent to the furnace, the prior art registers were unreliable and subject to frequent and costly repair efforts. These repairs would require the shutting down of the furnace facility at considerable expense and inconvenience to the operator of the furnace (usually an electrical generation utility).

In addition, the prior art registers introduced secondary air into the furnace in a turbulent but generally random pattern with only a small and ineffective swirl component. This led to the incomplete combustion of the fuel and to erosion of the furnace walls in the vicinity of the burner due to the action of deposits of only partially burned fuel along the furnace walls. Moreover, the prior art registers required the introduction of large amounts of secondary air even when the burner was idle in order to protect the register from heat damage. This required that the furnace be equipped with the capacity to generate and otherwise process large amounts of secondary air and led to the problem of erosion or wear damage occurring in the various furnace components exposed to the higher velocity air flow (e.g., fans, registers, heat exchangers, superheaters, etc. It is noted that the wear resulting from the gas flow against the elements in the flow path is a function of the cube of the gas velocity.

The operation of prior art registers resulted in inefficient furnace operation, especially at low loads. Moreover, due to the lack of a well defined fuel/air flow pattern, there was a tendency in prior art furnaces for the intense heat and pressure variations existing in the furnace to cause the fuel from the nozzle to be "blown" against the relatively cold furnace walls. This resulted in poor combustion of the coal and additional damage to the furnace walls.

SUMMARY OF THE INVENTION

Accordingly it is an object of the present invention to provide an improved device for supplying secondary air to a furnace.

It is a further object of the present invention to provide a device for controlling both the volume and flow pattern of the secondary air to a furnace burner.

It is a still further object of the present invention to provide a furnace burner register assembly having a decreased pressure drop.

It is yet a further object of the present invention to provide a furnace burner register assembly which will decrease the rate of erosion of the furnace walls.

Another object of the present invention is to provide a furnace burner register assembly which will retain fuel particles in a controlled air flow to improve combustion.

It is a still further object of the present invention to provide a furnace burner register assembly which will operate to form the secondary air into a controlled vortex to project the fuel further into the furnace interior.

It is a further object of the present . invention to provide a furnace burner register which is economical in the use of secondary air.

It is a still further object of the present invention to provide a furnace burner register of durable but simple design and construction so as to be extremely reliable in operation.

It is a still further object of the present invention to provide a furnace burner register assembly which requires a reduced amount of secondary air to cool the burner register when the burner is idle.

It is yet another object of the present invention to provide a furnace burner register assembly, which enhances the efficiency of the furnace thus resulting in the use of less fuel to produce a given amount of heat and the generation of fewer objectionable effluents.

In accordance with the present invention an air register assembly is provided which imparts a controlled vortex swirl to the secondary combustion air in order to entrain the ignited fuel and primary air and carry them into the interior of the furnace to thereby afford the fuel particle, e.g., coal, an opportunity to fully combust and to prevent the fuel from damaging the furnace walls. The register preferably comprises a series of circumferentially spaced vanes positioned axially about a fuel nozzle and designed to induce both turbulence and a well defined vortex to the secondary air at various gas flow values ranging from 0.1 to 2 times the nominal flow.

Preferably, a separate device, such as a butterfly valve, is provided to regulate the volume of secondary air flow. Providing a separate flow volume regulating device simplifies the register structure and enhances its reliability by removing the need for movable vanes and associated actuating structure which is usually positioned proximate to the furnace walls.

Preferably, shadow vanes are provided in order to protect the register from the furnace heat, particularly when the burner is idled and the secondary air flow is lowered. The shadow vanes may consist of circumferentially spaced, radial vanes, positioned at the outlet of the air register and between the air register and the furnace wall.

The secondary air supply register, in accordance with the present invention, is mechanically simple in construction and operation and enhances the durability and efficiency of the furnace as a whole.

Additional objects, advantages and novel features of the invention will be set forth in part in the description which follows, and in part will become apparent to those skilled in the art upon examination of the following or may be learned by practice of the invention. The objects and advantages of the present invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate the preferred embodiment of the present invention, and together with the description, serve to explain the principles of the present invention. Like elements are similarly numbered in the various drawings. In the drawings.

DETAILED DESCRIPTION OF THE INVENTION

Reference will now be made in detail to the present preferred embodiment of the invention, an example of which is illustrated in the accompanying drawings.

Figure 4:
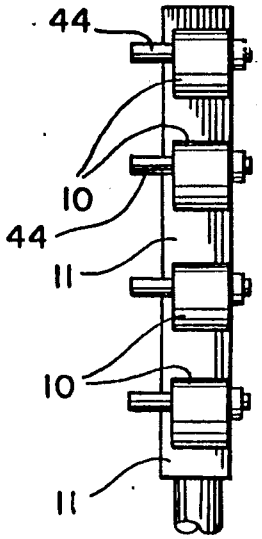
Figure 1:
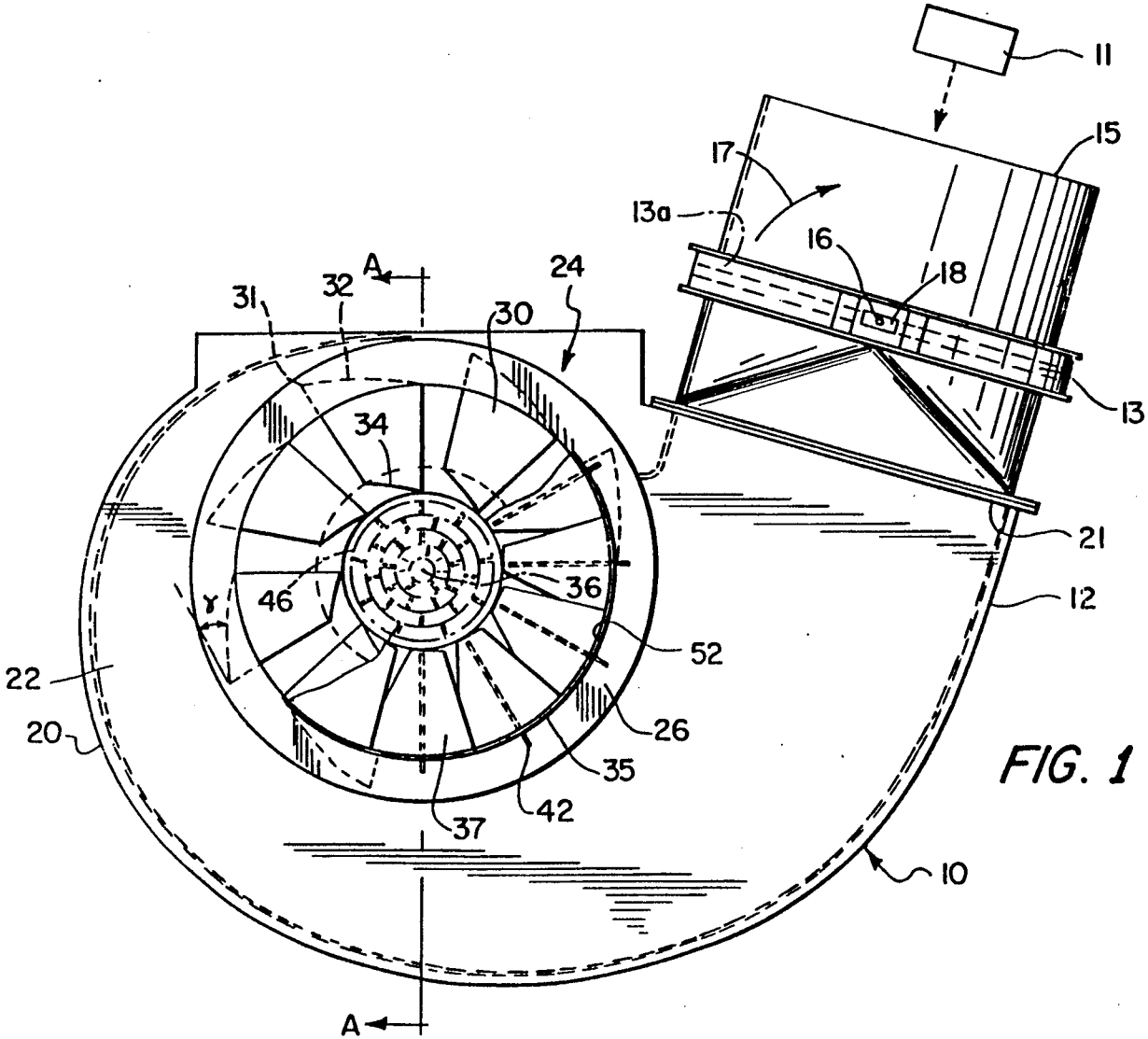
FIG. 1 is a plan view, in partial section, of a burner register assembly in accordance with the present invention.
Figure 2:
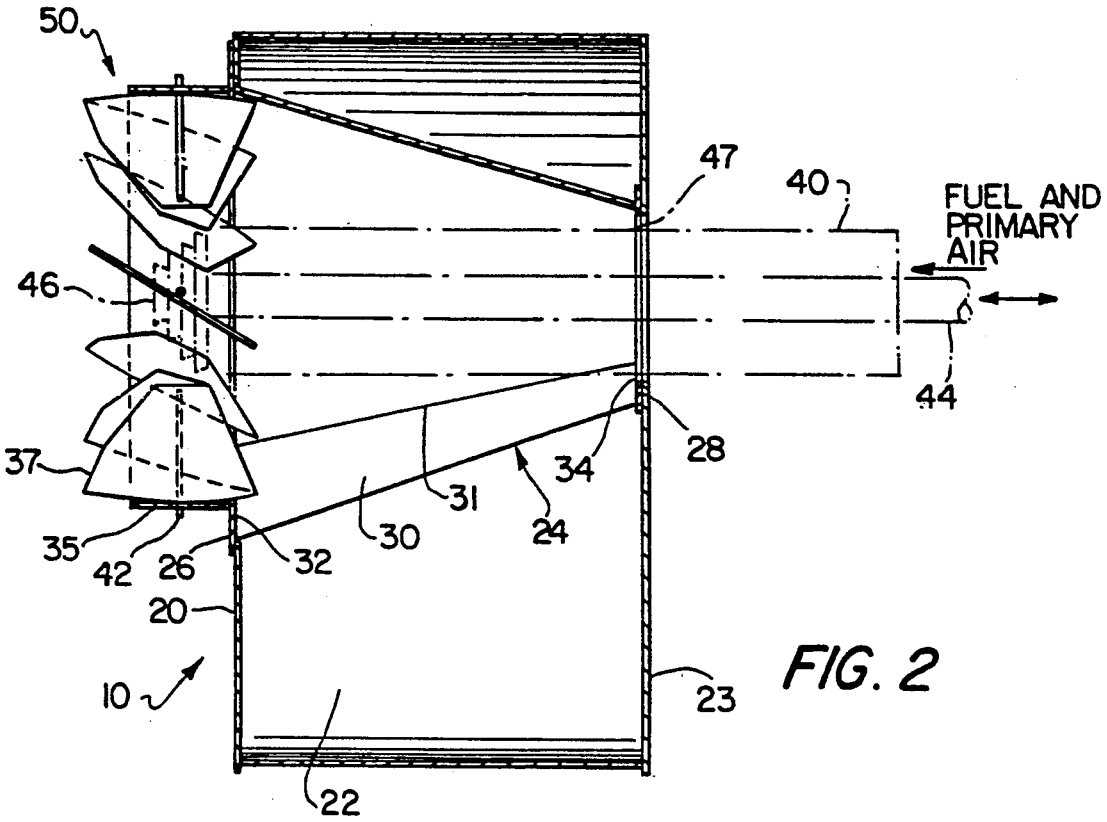
FIG. 2 is a side view, through section lines A—A of FIG. 1, of a burner register assembly in accordance with the present invention.

Turning first to FIGS. 1 and 2, there is generally depicted a secondary air supply, vortex imparting air register assembly 10, in accordance with the present invention. The assembly 10, which has a body 12, is adapted to be used in a furnace having a secondary air supply plenum ("windbox") (schematically illustrated and referred to by reference character 11 in FIG. 1) and heat exchange type furnace walls into which the assembly is intended to be inserted. Secondary air enters the register assembly, from a windbox through the inlet duct or passageway 15 and passes through isolation valve 13. The valve 13 is used to control the volume of air to the register and may comprise a simple butterfly valve. Of course, as a butterfly valve, and as will be apparent from the drawing, valve 13 will have a single movable valve member 13*a* which pivots about axis 16 in the direction of the arrow 17. Of course, too, in a valve of such construction, the valve member 13*a* extends entirely across the inlet passageway 15. A mechanism 18 is provided in order to control the movement of the valve 16. As will be understood by the artisan, the position of the valve 13 may be automatically controlled by mechanical, electrical, hydraulic or pneumatic means in response to detected effluent parameters such as mass flow rate, temperature, oxygen content, etc. or may be manually controlled. The valve 13 is preferably provided with a gasket or sealing means to seal the duct 15 when required.

It should be understood that other air flow control devices can be substituted for the butterfly valve 13 within the scope of the invention. For instance, a pivoting louver, a flap valve or a poppet type air valve may be substituted for the butterfly valve. It is, however, important that the valve does not introduce excessive pressure drop to the system and that it is capable of controlling the air flow to the register.

After the secondary air passes through isolation valve 13, it enters inlet 21 and it traverses a scroll section 22 which may be provided with a front cover 20 and a rear cover 23 (see FIG. 2). As will be seen from the drawing, the "scroll" is in the form of a spiral passageway in which the upstream part of the passageway is at the center part of the spiral and the downstream part of the passageway is at the inner part of the spiral. The passageway converges from a relatively large cross-sectional area (with respect to its axis) at the outer part of the spiral to a relatively smaller cross-sectional area at the inner part of the spiral. That is, the scroll section has the shape of a nautilus shell. While traversing the scroll section, the air is uniformly distributed about the swirl vane assembly (generally 24) and simultaneously is accelerated in an angular direction to impart a swirling movement to the air.

The swirl vane assembly 24 preferably consists of front and rear mounting rings 26 and 28, respectively, between which are mounted a plurality of elongated, arcuate, tapered vanes 30. The vanes are preferably fixed between the rings 26 and 28 and are designed to impart a well-defined vortex swirl to the secondary air flow. The vortex pattern of the secondary air will remain well defined at various flow rates ranging from 0.1 to over twice the nominal secondary air flow.

The spread or dispersion of the swirl can be adjusted to accommodate the nature and quality of the fuel involved. For instance, for a low moisture or low density coal fuel a slightly spread vortex would be desirable. For a higher density fuel, a narrower vortex may be used to ensure that the fuel remains entrained in the air vortex well into the furnace interior.

As will be understood by the artisan, this adjustment can be accomplished by adjusting the radial pitch of the vanes 30 or their profile or any other equivalent modification. The vanes 30 can be made adjustable by providing them with an axis about which they can rotate under the influence of an actuator or by making the shape of the swirl vanes 30 themselves variable. Equivalent mechanisms to render the vanes adjustable will suggest themselves to the artisan and are contemplated to be within the scope of the present invention.

It should be understood that while a fixed vane is preferred for simplicity, ruggedness and ease of operation, for some applications a degree of adjustment may be provided to add versatility to the air register assembly. It should be emphasized, however, that unlike the prior art which utilized a complex and unreliable set of movable vanes to control the air flow and direction, the present invention contemplates a strong, simple and reliable vane assembly construction.

The vanes 30 have arcuate surfaces and are preferably designed so that the front edge 32 thereof forms an angle $\alpha$ with respect to the tangent line of the arcuate surface. The angle $\alpha$ is approximately in the range of 20°-80° and more preferably in the general range of about 25°-60°. For most applications, an angle of 45° can be used.

This rear edge 34 of the vane is similarly disposed in the rear mounting ring 28.

Figure 3A:
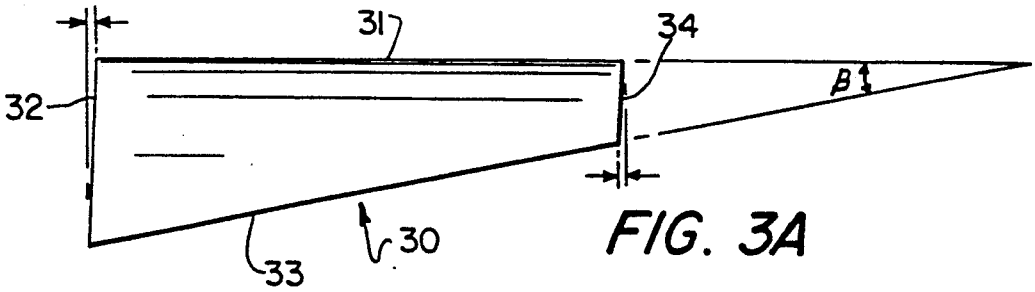
FIG. 3A is a side projection of a vortex vane for an air register assembly of the present invention.
Figure 3B:
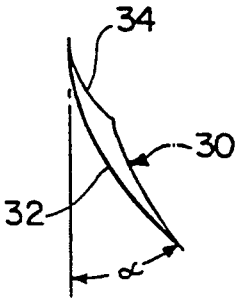
FIG. 3B is an end projection of the vortex vane of FIG. 3A.

These vanes are preferably configured such that the leading edge 31 is parallel to the incoming secondary air flow. The vanes are formed at an angle to the axis of the assembly so as to impart the desired vortex motion to the secondary air. As viewed from the left side in FIG. 2, the edges 31 and 33 (FIG. 3A) if extended, would converge at the axis of the register. The exact shape of the edges 32 and 34 is determined in part by the size of the front and rear mounting rings 26 and 28 and in part by the desired characteristics of the vortex. The angle $\beta$ included by the leading and trailing edges 31 and 33 of the vane may be on the order of about 4°-45° and more preferably in the range of about 6°-25°.

Positioned adjacent to the front mounting ring 28 and front cover 20 is the shadow vane assembly 50. The shadow vane assembly includes a mounting ring 35. As will be understood by the artisan, the mounting ring 35 is adapted to be positioned along an interior wall of a furnace (not shown) and facing into the furnace. The ring functions to support a set of shadow vanes 37 which are disposed circumferentially about the ring. The vanes 37 perform several functions. The shadow vanes may aid in controlling the size and intensity of vortex formed by the vortex or swirl vanes 30. In addition, these vanes protect the swirl vane register air assembly 24 from the radiant heat of the furnace.

When viewed directly along the axis of the burner register assembly 10 the shadow vanes 37 appear to substantially completely close the outlet opening (except for the burner nozzle). Because the shadow vanes thus substantialy completely cover a plane perpendicular to the axis of the burner register assembly at the outlet opening (except for the burner nozzle) they will reflect much of the radiant energy of the furnace back to the furnace to prevent it from damaging the air register assembly, particularly when the associated burner is idle. Of course, even though the shadow vanes substantially cover the aforementioned plane, they do not substantially close the outlet opening with respect to air flow. The secondary air will enter the outlet in a vortex flow pattern, and the shadow vanes will be disposed at angles roughly corresponding to the direction of vortex flow. Thus, they do not substantially restrict the flow of secondary air through the outlet. In other words, pressure drop across the shadow vanes is as small as possible, preferably negligible.

As illustrated in FIGS. 1 and 2, the individual shadow vanes 37 may preferably be in the form of generally trapazoidal fins having two opposed converging edges spaced in an axial direction with respect to the axis of the burner register assembly and the other two opposing edges generally parallel and radially spaced with respect to the axis.

While FIGS. 1 and 2 depict a preferred form of the shadow vane assembly, it should be appreciated that the shadow vanes may be constructed in the form of a louver comprised of a plurality of concentric circular flow directing members or any other louver arrangement which will permit the passage of secondary air in a vortex swirl without disrupting that flow or introducing excessive pressure drop and which will provide protection from radiant heat damage to the swirl vane air register assembly 24.

The shadow vanes 37 function to protect the air register (swirl vane register assembly 24) from the radiant heat of the furnace when the burner 40 (see dashed lines in FIGS. 1 and 2) is idle. In the prior art, considerable air had to be directed through the secondary air supply to protect the air register from damage due to the intense heat of the furnace even when the burner was idle. The capacity to provide this air required enormous amounts of capital equipment and operating energy expenditure for compressors, fans, cleaners, extractors, etc. Moreover, the increased volume of air required to protect the prior art air registers added to the erosion damage of the furnace components located within the furnace gas flow. Moreover, this protective air represents waste gas which adversely influences the efficiency of the furnace by simply venting from the furnace much of the heat generated in the form of heated waste gas.

With the present invention, the amount of air flow needed to protect the air register assembly 24 of an idle burner is significantly decreased from the prior art devices, thus resulting in considerable cost and energy savings. The saving is especially significant when the furnace is operating at low load as in the case of utility generating stations whose load factor varies considerably over the course of a day.

The vanes 37 are preferably attached to mounting ring 35 by means of pins 42. For fixed vanes the pins may be welded to the vanes 37 and the ring 35 in order to hold the vanes rigidly in place. Alternately, the vanes may be constructed so as to pivot about the axis of the pin 42 or similar element so as to enable additional control over the flow of secondary air as described hereinabove. The vanes, where adjustable, may be rotated in response to sensed effluent parameters such as temperature, flow rate, effluent gas concentrations, etc.

Because of the above-mentioned benefits of the air register assembly and flow control of the present invention, the general efficiency of the furnace is increased thus requiring the burning of less fuel and consequently less production of objectionable exhaust gas constituents.

In operation, primary air and fuel enter the furnace through inlet 40 and are conventionally injected through adjustable diffuser nozzle 44 having diffuser elements 46. As will be apparent from the foregoing and from the drawing, the body 12 of the air register 10 surrounds the fuel and primary air nozzle 44; that is, the fuel and primary air nozzle 44 is mounted in an axial opening 47 in body 12. It should be noted that in FIGS. 1 and 2 the above-mentioned burner nozzle and primary air systems are schematically illustrated by dashed lines. These elements are illustrated for explanatory purposes only and form no part of the present invention.

Secondary air enters the inlet duct 15. The volume of secondary air introduced is controlled by the isolation valve 13. The secondary air then passes through the scroll section 22 and is distributed about the air register assembly 24 and simultaneously accelerated in an angular direction. The air then passes through the low pressure drop swirl air register assembly 24 where a well-defined vortex is imparted to it.

The vortex of secondary air entrains the injected primary air and fuel and carries it well out into the furnace past the shadow vanes 37. The shadow vanes may also operate to impart an additional component to the flow to modify the vortex depending upon the nature and quality of the fuel or other variables, thus resulting in enhanced fuel burning, increased furnace efficiency and less pollution generation. The present invention also requires the use of less secondary air than prior furnace registers thus saving additional costs in equipment, maintenance and efficiency. Moreover, the present invention is simple, rugged and reliable and can be constructed utilizing only one movable component, the isolation valve 13, which is located remote from the furnace itself and is, therefore, protected from the severe environment which exists adjacent to the furnace.

The foregoing description of the preferred embodiment of the invention has been presented for purposes of illustration and description. It is not intended to be exhaustive or to limit the invention to the precise form disclosed, and obviously many modifications and variations are possible in light of the above teaching. For example, the isolating valve may consist of any air valve which can control the volume of secondary air to the scroll section. The geometry of the vortex vanes 30 is illustrative only and can be modified so long as an appropriate vortex is imparted to the secondary air. The shadow or outlet vanes may likewise be fashioned of various known low pressure drop arrangements for directing air flow while providing protection from radiant heat. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A burner register assembly for controlling a supply of secondary air to a furnace having a fuel and primary air nozzle and a secondary air supply, comprising:

a) a body;

b) an air valve in said body for controlling the amount of secondary air admitted to the burner register assembly;

c) means in said body for mounting the fuel and primary air nozzle with respect to said body so that said body surrounds the nozzle; said mounting means including an axial opening through said body; and d) means in said body for uniformly distributing air about said mounting means to effect a controlled pattern of discharge of secondary air into the furnace, said uniform distributing means including a scroll section in said body, said scroll section having a scroll passageway which spirals inwardly in the direction of a secondary air flow therethrough, said scroll section communicating with said air valve, said air valve being disposed upstream of such scroll section.

2. The burner register assembly of claim 1, wherein said air valve has a single movable valve element for controlling air flow through said valve.

3. The burner register assembly of claim 1 including a secondary air inlet passageway leading to said scroll passageway and wherein said air valve is a valve having a movable valve closure member which extends entirely across said inlet passageway for controlling air flow through said valve.

4. The burner register assembly of claim 1, wherein said body includes an outlet for discharging secondary air into the furnace, said outlet having an axis, and further comprising means coupled with said body for minimizing the amount of secondary air required for cooling the burner register assembly when idle, said minimizing means comprising a shadow vane assembly having a plurality of shadow vanes which substantially completely cover a plane perpendicular to the axis of said outlet without substantially restricting said outlet with respect to air flow.

5. A burner register assembly for controlling a supply of secondary air to a furnace having a fuel and primary nozzle and a secondary air supply, comprising:

a) a body having a secondary air passageway therethrough;

b) an air valve in the said body for controlling the amount of secondary air admitted to the burner register assembly, said air valve having only a single movable valve member in said passageway for selectively restricting the flow of air through said passageway; and c) an axially extending opening through said body for mounting the fuel and primary air nozzle, said body surrounding said opening;

d) said passageway through said body being at least partially defined by a scroll section of said body, said passageway spiraling inwardly in said scroll section, said inwardly spiraling passageway decreasing in cross section in the direction of inward spiral.

6. The burner register assembly of claim 5, wherein said air valve is disposed upstream of said scroll section and wherein said movable valve member of said air valve extends entirely across said secondary air passageway.

7. A burner register assembly for use in a furnace having a fuel and primary air supply and a secondary air supply, comprising:

a) an air valve adapted to communicate with the secondary air supply for controlling the admission of secondary air to the register assembly;

b) an air register assembly having an inlet for admitting secondary air into said air register assembly and an outlet for discharging secondary air into the furnace, said air register assembly including a scroll section communicating with said air valve for the secondary air for imparting a vortex to the secondary air to create a controlled pattern of secondary air flow into the furnace, said scroll section having a scroll passageway which spirals inwardly in the direction of secondary air flow therethrough, said air valve being coupled to said air register assembly adjacent said inlet and upstream of said scroll section;

c) a shadow vane assembly positioned proximate to said outlet to protect said air register assembly against radiant heat from the furnace, said outlet having an axis, said shadow vane assembly substantially completely covering a plane perpendicular to the axis of said outlet without substantially restricting said outlet with respect to air flow, said shadow vane assembly including a plurality of vanes disposed generally radially with respect to said axis and having generally flat surfaces inclined at an angle with respect to said axis, said vanes including generally trapezoidal fins having opposing converging edges spaced in an axial direction with respect to said axis and opposing generally parallel edges spaced in a radial direction with respect to said axis, the radial edge located furthest from said axis being larger than the opposing radial edge.

8. The burner register assembly of claim 7, wherein said shadow vanes are fixed.

9. A burner register assembly for use in a furnace having a fuel and primary air supply and a secondary air supply, comprising:

a) an air valve adapted to communicate with the secondary air supply for controlling the admission of secondary air to the register assembly, said air valve being a butterfly valve with an actuator for adjusting the position of the valve to thereby control the volume of secondary air entering the burner register assembly;

b) an air register assembly having an inlet for admitting secondary air into said air register assembly and an outlet for discharging secondary air into the furnace, said air register assembly including a scroll section communicating with said air valve for the secondary air for imparting a vortex to the secondary air to create a controlled pattern of secondary air flow into the furnace, said scroll section having a scroll passageway which spirals inwardly in the direction of secondary air flow therethrough, said air valve being coupled to said air register assembly adjacent said inlet and upstream of said scroll section.

10. A burner register assembly for use in a furnace having a fuel and primary air supply and a secondary air supply, comprising:

a) an air valve adapted to communicate with the secondary air supply for controlling the admission of secondary air to the register assembly;

b) an air register assembly having an inlet for admitting secondary air into said air register assembly and an outlet for discharging secondary air into the furnace, said air register assembly including a scroll section communicating with said air valve for the secondary air for imparting a vortex to the secondary air to create a controlled pattern of secondary air flow into the furnace, said scroll section having a scroll passageway which spirals inwardly in the direction of secondary air flow therethrough, said air valve being coupled to said air register assembly adjacent said inlet and upstream of said scroll section;

c) at least two axially spaced and aligned mounting rings and a plurality of swirl vanes circumferentially spaced about said mounting rings and extending lengthwise between said rings, said swirl vanes being circumferentially spaced and positioned generally along the surface of an imaginary truncated cone centered about an axis of said air register assembly, whereby a projection of said swirl vanes generally converges on said axis at approximately the vortex of said truncated cone and whereby said truncated cone opens in the direction of said air swirl, each of said swirl vanes having a leading edge and a trailing edge with respect to the direction of flow of said secondary air, said training edge being positioned radially inward toward said axis from said leading edge and being connected to said leading edge by a generally arcuate surface.

11. A burner register assembly for controlling a supply of secondary to a furnace, comprising:

a) means for controlling the volume of air admitted to the assembly;

b) means for creating a controlled pattern of secondary air flow into the furnace, said controlled pattern creating means including a secondary air register which has a scroll section positioned downstream of said volume controlling means with respect to the direction of flow of said secondary air for imparting a vortex to said secondary air to create a swirl; whereby the secondary air to the furnace has a well-defined vortex to effect a controlled pattern of combustion in the furnace, said scroll section having a scroll passageway which spirals inwardly in the direction of secondary air flow therethrough, said secondary air register including a plurality of swirl imparting vanes circumferentially spaced about and extending between a pair of mounting rings axially aligned and spaced, each of said swirl vanes having a leading edge and a trailing edge with respect to the direction of flow of said secondary air, said trailing edge being positioned radially inward toward said axis with respect to said leading edge and being connected to said leading edge by a generally arcuate surface, wherein said swirl vanes are positioned generally along the surface of an imaginary truncated cone, a projection of which cone converges at an apex on said axis and which cone opens in the direction of the furnace.

12. A burner assembly for use in a furnace having a fuel and a primary air supply and a secondary air supply, comprising:

a) an air valve adapted to communicate with the secondary air supply for controlling the admission of secondary air to the register assembly, said air valve having a single movable valve closure member for controlling air flow through said valve;

b) an air register assembly having an inlet for admitting secondary air into said air register assembly and an outlet for discharging secondary air into the furnace, said air register assembly including a scroll section communicating with said air valve for the secondary air for imparting a vortex to the secondary air to create a controlled pattern of secondary air flow into the furnace, said scroll section having a scroll passageway which spirals inwardly in the direction of secondary air flow therethrough, said air valve being coupled to said air register assembly adjacent said inlet and upstream of said scroll section.

13. A burner register assembly for use in a furnace having a fuel and primary air supply and a secondary air supply, comprising:

a) an air valve adapted to communicate with the secondary air supply for controlling the admission of secondary air to the register assembly;

b) an air register assembly having an inlet for admitting secondary air into said air register assembly and an outlet for discharging secondary air into the furnace, said air register assembly including a scroll section communicating with said air valve for the secondary air for imparting a vortex to the secondary air to create a controlled pattern of secondary air flow into the furnace, said scroll section having a scroll passageway which spirals inwardly in the direction of secondary air flow therethrough, said air valve being coupled to said air register assembly adjacent said inlet and upstream of said scroll section;

c) a secondary air inlet passageway adjacent said air register assembly and disposed upstream of said scroll passageway for admitting secondary air into said scroll passageway, said air valve having movable valve closure member which extends entirely across said inlet passageway for controlling air flow through said valve.

14. A burner register assembly for controlling a supply of secondary air to a furnace, comprising:

a) means for controlling the volume of air admitted to the assembly, said means for controlling the volume of air admitted into the assembly being a valve having a single movable valve closure member;

b) means for creating a controlled pattern of secondary air flow into the furnace, said controlled pattern creating means including a secondary air register which has a scroll section positioned downstream of said volume controlling means with respect to the direction of flow of said secondary air for imparting a vortex to said secondary air to create a swirl; whereby the secondary air to said furnace has a well-defined vortex to effect a controlled pattern of combustion in the furnace, said scroll section having a scroll passageway which spirals inwardly in the direction of secondary air flow therethrough.

15. A burner register assembly for controlling a supply of secondary air to a furnace, comprising:

a) means for controlling the volume of air admitted to the assembly;

b) means for creating a controlled pattern of secondary air flow into the furnace, said controlled pattern creating means including a secondary air register which has a scroll section positioned downstream of said volume controlling means with respect to the direction of flow of said secondary air for imparting a vortex to said secondary air to create a swirl; whereby the secondary air to said furnace has a well-defined vortex to effect a controlled pattern of combustion in the furnace, said scroll section having a scroll passageway which spirals inwardly in the direction of secondary air flow therethrough;

c) a secondary air inlet passageway leading to said scroll passageway, said means for controlling the volume of air admitted into the assembly being a valve having a movable valve closure member which extends entirely across said inlet passageway for controlling air flow through said valve.

* * * * *